US005894922A

United States Patent [19]

Miller et al.

[11] Patent Number: 5,894,922

[45] Date of Patent: Apr. 20, 1999

[54] CARRYING CASE

[75] Inventors: D. Scott Miller, Orlando, Fla.; James D. Orr, Columbus; Michael A. Lorenz, Gahanna, both of Ohio

[73] Assignee: Dart Industries Inc., Orlando, Fla.

[21] Appl. No.: 09/042,765

[22] Filed: Mar. 17, 1998

[51] Int. Cl.[6] ..... A45C 11/34

[52] U.S. Cl. ..... 206/214; 206/371; 220/528

[58] Field of Search ..... 206/0.81, 214, 206/371, 457; 220/520, 523, 528

[56] References Cited

U.S. PATENT DOCUMENTS

| | | | |
|---|---|---|---|
| 2,731,996 | 1/1956 | Hayes . | |
| 3,025,947 | 3/1962 | Hammer . | |
| 3,061,136 | 10/1962 | Stermgart | 220/523 |
| 3,786,913 | 1/1974 | Crawford . | |
| 4,541,528 | 9/1985 | Holmes . | |
| 4,545,487 | 10/1985 | Asmus . | |
| 4,946,413 | 8/1990 | Lehmann et al. . | |
| 5,353,947 | 10/1994 | Zinnbauer et al. . | |
| 5,441,149 | 8/1995 | Willard et al. | 206/214 |
| 5,495,938 | 3/1996 | Bedford et al. | 206/371 |
| 5,680,932 | 10/1997 | Dickinson et al. | 220/523 |
| 5,806,670 | 9/1998 | Harlan et al. | 220/523 |

*Primary Examiner*—David T. Fidel
*Attorney, Agent, or Firm*—John A. Doninger; Taylor J. Ross

[57] ABSTRACT

A carrying case for small items including a removable tray received between and generally coextensive with an elongate base and a cover integrally hinged thereto, the tray including a peripheral flange member received between the overlying base and cover with the interior of the tray divided into three compartments, one of which includes a pivotally mounted lid. A partition dividing the two remaining compartments extends through the top panel of the closed cover and provides a release extension for facilitating removal of the tray from the cover.

17 Claims, 4 Drawing Sheets

CARRYING CASE

BACKGROUND OF THE INVENTION

Carrying cases with both soft bodies and rigid bodies are provided for a variety of purposes. One of the most common uses for such cases is as a student's school box for the carrying of school supplies, including pencils, erasers, lunch money and such other items as pictures, mementos and the like considered "essential" by the student.

The basic school box has, for years, been a rather large flat single-compartment box, much in the nature of a cigar box, wherein the items are loosely placed and inherently in disarray within the box. Further, the conventional box frequently has no latch means, and relies on either the firm grasp of the child to retain the box closed or some external means such as a rubber band. Additionally, the common rectangular box is a rather awkward item to both carry and store.

SUMMARY OF THE INVENTION

The case of the present invention, formed of a substantially rigid, weather-proof synthetic resinous material, is of a compact, streamline configuration, basically elongate with a narrow leading end, smoothly rounded corners and a transverse width and a height as to enable the case to be readily grasped.

It is of particular significance that the case of the invention is so formed as to effectively separate and organize the contents in multiple compartments sufficiently spacious as to accommodate most school supplies, and other "necessary" items for ready and convenient access thereto.

Basically, the case of the invention includes an outer shell formed of a base and cover, both relatively deep and joined, along a common longitudinal edge, by a living hinge. The opposed or free longitudinal edges are selectively locked by snap-latch means which automatically engages upon a closing of the cover over the base, effectively retains the cover closed, and is easily released by manual manipulation.

The interior of the shell is vertically divided into two full-length and full-width compartments by a removable tray. The tray in turn defines a main upwardly opening compartment divided into two compartment portions by a vertical partition, and a smaller, separately closed coin compartment for lunch money, "secret" or "special" items of the child and the like. As will be recognized, upon a removal of the tray, the shell will form a single large compartment should such be desired.

The tray will be snugly received within and between the base and cover of the shell, with convenient means being provided to release the tray from either or both of the base and cover should the snug relationship of the tray within the shell require such. As desired, the relationship between the tray and shell cover may provide for sufficient frictional engagement therebetween as to automatically raise the tray as the cover is opened to expose the bottom compartment.

Further objects and features of the invention will become apparent from the following more detailed description of the invention.

DESCRIPTION OF PREFERRED EMBODIMENT

Figure 1:
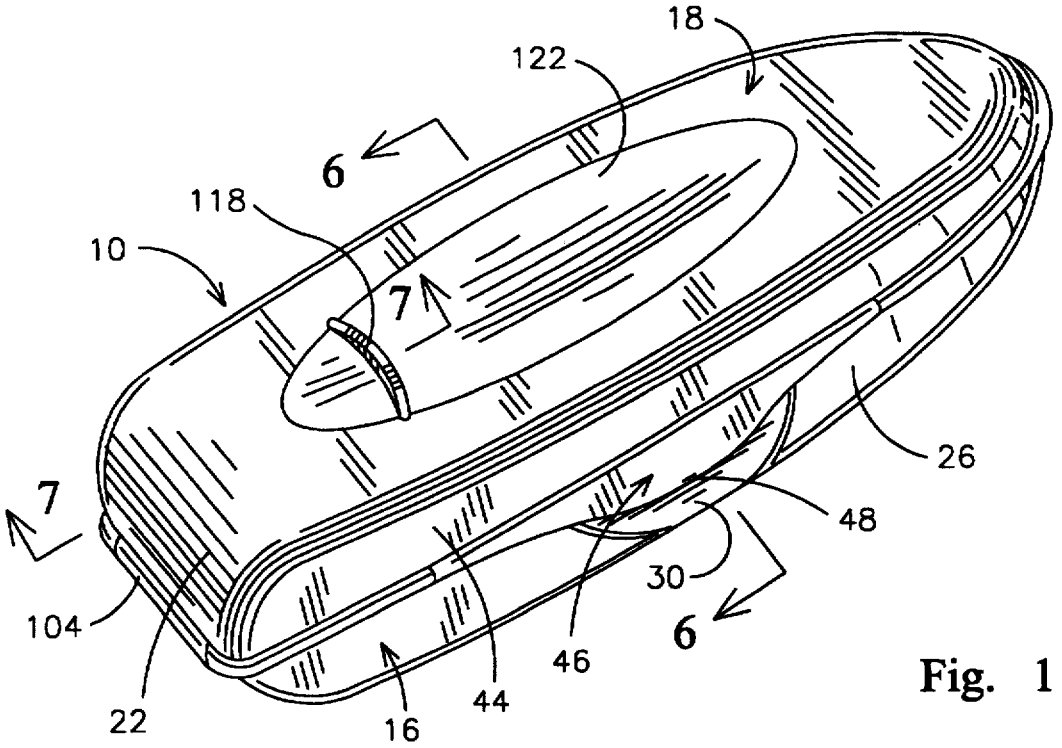
FIG. 1 is a perspective of the closed case.
Figure 2:
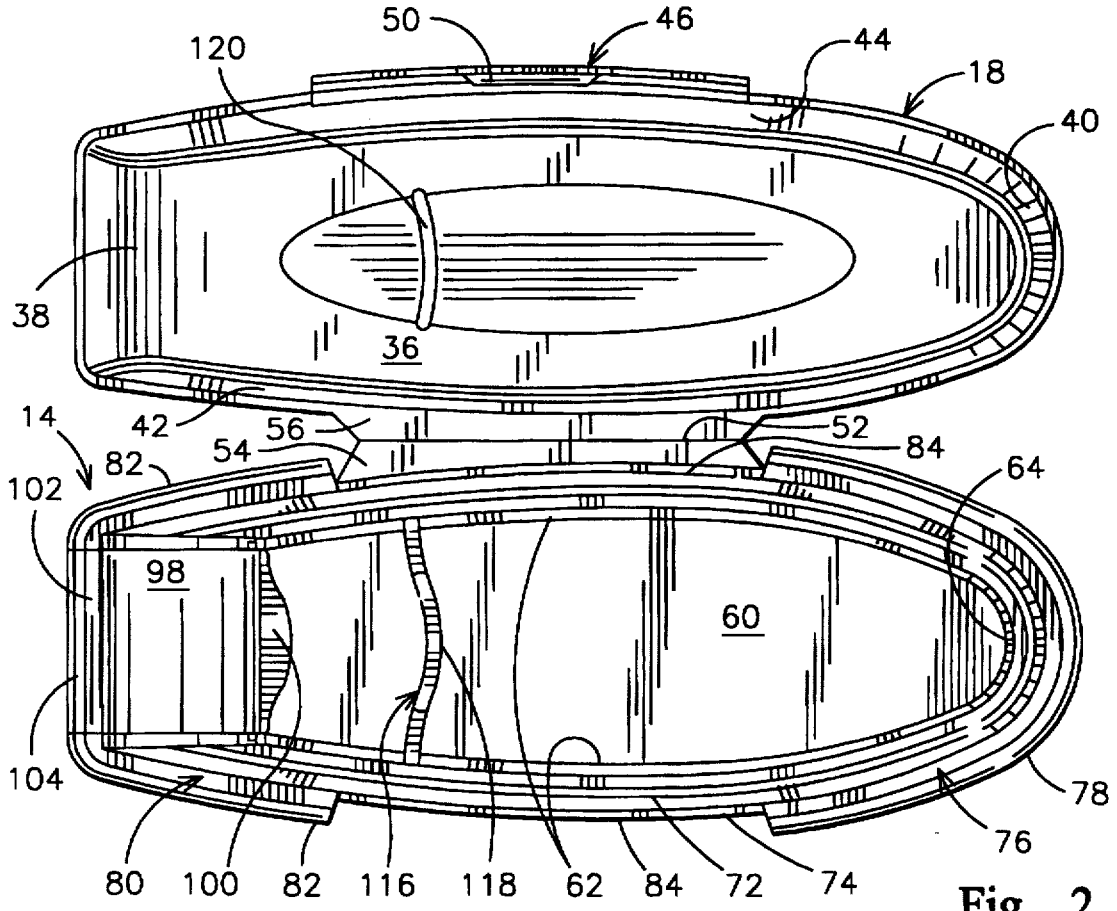
FIG. 2 is a top plan view of the open case with the tray in the base.
Figure 3:
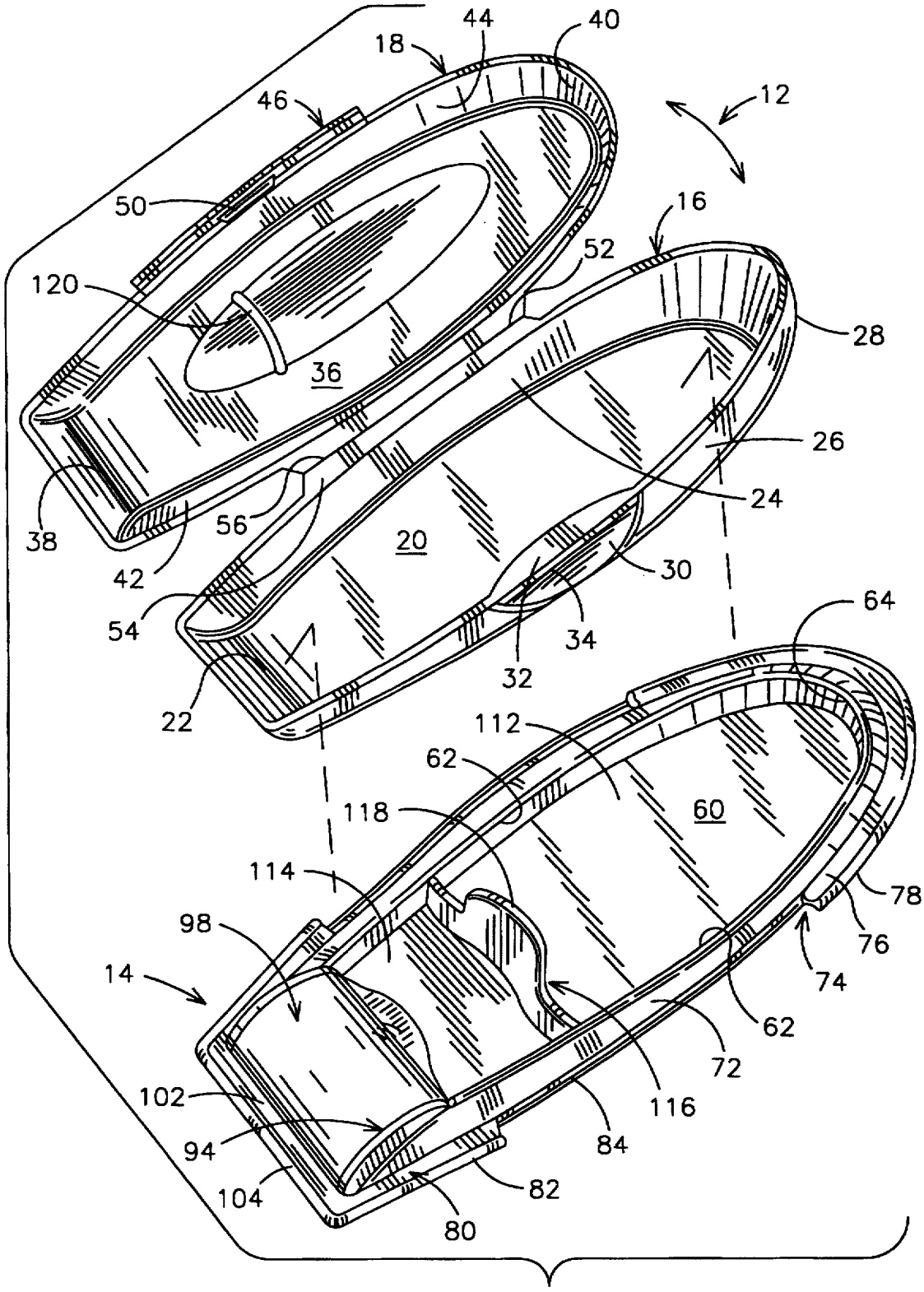
FIG. 3 is an exploded perspective view of the open shell and the tray.

Referring now more specifically to the drawings, the case 10 consists basically of two components, the shell 12 and the removable tray 14.

The shell 12 comprises an elongate base 16 and a coextensive cover 18. The base 16 includes a planar bottom 20 which, at one transverse end thereof, arcs upwardly to define a first end wall 22. Opposed rear and front longitudinally extending walls 24 and 26, integral with the side edges of the bottom 20 and the end wall.22, extend forwardly from the end wall along a slightly arcuate path and terminate in an arcuate second end wall 28 narrower than the first end wall 22, basically forming a "boat hull" configuration molded as a single unit with all of the formed corners, as between the walls and the bottom, rounded to avoid sharp edges.

The upper edges of the end walls 22 and 28, and the rear and front walls 24 and 26 are in a common plane and define a support surface for the tray 14 as shall be described presently. The front wall 26, at a central area therealong conforming to the widest portion of the base 16 and shell 12, is slightly inwardly offset to define an access recess 30 of partially circular configuration. The top edge of the wall 26, at a portion 32 thereof overlying the recess 30, forms a panel which is of a general segment configuration in plan so as to overlie the concave recess 30 and define a free latching or keeper edge 34 in a common plane with the outer surface of the front wall 26 beyond the recess 30.

The cover 18 is configured quite similar to the shell base 16 in that it includes an elongate top panel 36 with first and second end walls 38 and 40, and opposed rear and front walls 42 and 44 with coplanar outer edges which, in the closed shell, directly align with and overlie the outer edges of the walls of the shell base. As with the base, the edges and corners defined between the walls and the walls and top panel 36 are rounded to avoid sharp edges and provide a measure of safety for young users of the case 10. As desired, the walls of both the base 16 and the cover 18 can incline slightly outward as they extend from the respective panels 20 and 36.

Figure 6:
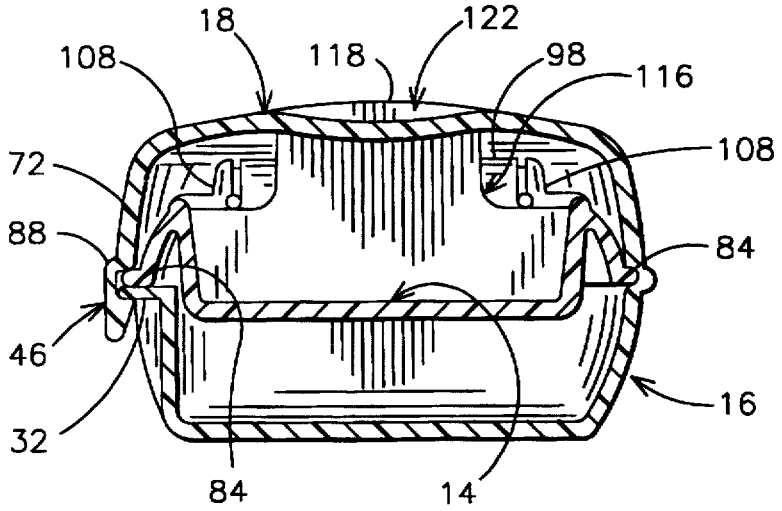
FIG. 6 is a transverse cross-sectional view through the latch assembly and the hinge of the shell, taken substantially on a plane passing along line 6—6 in FIG. 1.

The front wall 44 of the cover 18, along the central portion thereof, includes a downward and outwardly flaring latch 46 integral with the wall 44 and slightly forwardly offset therefrom and extending so as to, noting FIGS. 1 and 6, overlie the latch recess 30 in the base front wall 26. The latch 46, along the central portion thereof corresponding with the length of the recess 30, is relatively deeper than the side portions of the latch and has an easily grasped convex edge 48.

The actual latching effect is achieved by an elongate rib 50 integral with the inner face of the latch 46 intermediate the convex lower edge 48 and lower edge of the cover front wall 44. This rib 50, due to the inherent resilient flexibility of the material from which the case is formed, will, again noting FIG. 6, snap-lock below the keeper edge 34 on the base 16 to confine this keeper edge between the rib 50 and the lower edge of the cover front wall 44. With this latch assembly, a positive latching engagement is achieved between the cover and base capable of accommodating relatively rough handling by a child. At the same time, the latch is easily released by a mere outward and upward pressure on the lower convex edge 48 of the latch 46.

The base 16 and cover 18 are formed as a single unit with a living hinge 52 defined lengthwise along and between integral base and cover leaves 54 and 56 whereby the actual defined hinge 52 is slightly offset outward from the rear walls 24 and 42 of the base and cover to allow for a clamped reception of the tray 14 between the outer edges of the base and cover walls as shall be explained presently.

Turning now to the removable tray 14, the outer peripheral configuration thereof approximates that of the base 16 and cover 18 for a close reception therein. The tray 14 includes a planar bottom or bottom panel 60 with opposed elongate front and rear walls 62, an arcuate first end wall 64 and a transverse substantially straight second end wall 66 extending substantially perpendicular to the tray bottom 60. As noted in the detail of FIG. 7, the tray end wall 66 is of a substantially lesser height than the height of walls 62 and 64.

The wall 66 has an outwardly directed flange 68 integral therewith and along the length thereof. This flange 68 has a planar upper surface with an integral downwardly enlarged outer edge or bead 70, and engages on the upper edge of the end wall 22 of the shell base 16 with the enlarged edge 70 immediately outward of the wall 22 and the tray wall 66 immediately inward of the base wall 22.

A depending skirt 72 is integrally formed with the walls 62 and end wall 64 along the lengths thereof and adjacent the coplanar upper edges. The skirt 72 arcs outward and downward, terminating in an outwardly directed flange 74 coplanar with the end wall flange 68 to similarly engage on the upper edges of the base walls. The forward portion of the flange 74, indicated at 76 and encircling the arcuate end of the tray 14 and extending partially along walls 62, is of full width with the end wall flange 68 and terminates in a full length outer enlarged bead 78 for reception of the corresponding upper portions of the base walls and lower portions of the cover walls between the bead 78 and the tray body. The skirt flange 74, along the rear end portions of the opposed walls 62, as indicated at 80, are of a similar width as and merge integrally into the end wall flange 68, differing from this end wall flange only in the provision of a full height enlarged bead 82 for reception of the base and cover wall portions inward thereof. The flange 74, along both walls 62 between the rear flange portion 80 and the forward flange portion 76, as at 84, while engaging and seating on the upper edges of the opposed walls 24 and 26 of the shell base 16, are of a lesser width and do not include an outer coextensive bead. As will be appreciated, these central longitudinal reduced width portions 84 coincide with the length of the latch 46 and the substantially equal length hinge 52 and hinge leaves 54 and 56 to allow for free pivotal movement of the cover 18 and unencumbered engagement and disengagement of the latch assembly.

Noting FIGS. 6 and 7, it will be appreciated that the height of the flanges 68 and 74 are such as to position the bottom panel 60 of the tray 14 in vertically spaced relation above the bottom 20 of the shell base 16, thus providing for a useable compartment within the base below the tray. Similarly, the height of the tray walls is such as to provide for substantial useable space above the tray. With further reference to FIG. 6, it will be noted that the narrower portion 84 of the edge flange, as it seats on the panel 32 defining the keeper edge 34, is actually clamped to this panel 32 by the latch 46 which includes a slightly undercut inner corner 88 to receive the edge of the flange portion 84. It will also be seen from FIG. 6, that the opposite central flange portion 84 which aligns with the hinge leaves 54 and 56 is received between the corresponding rear wall edges of the base and cover for a clamped engagement with the leaves 54 and 56 either angled as molded or sufficiently inherently flexible to accommodate the edge of the narrower flange portion therebetween.

The interior of the tray 14 has multiple compartments, including a closable coin compartment formed immediately forward of the tray end wall 66 between the end wall 66 and a forwardly positioned transverse compartment wall 92. The compartment wall 92 is of a greater height than the tray end wall 66. Noting FIG. 8, the coin compartment 92 also includes opposed side walls 94 which are slightly inwardly enlarged relative to and extending upward from the curving rear portions of the tray walls 62. These walls 94 include arcuate upper edges and arcuate inwardly directed support shoulders 96 below said upper edges which receive and support the compartment lid 98.

Figure 4:
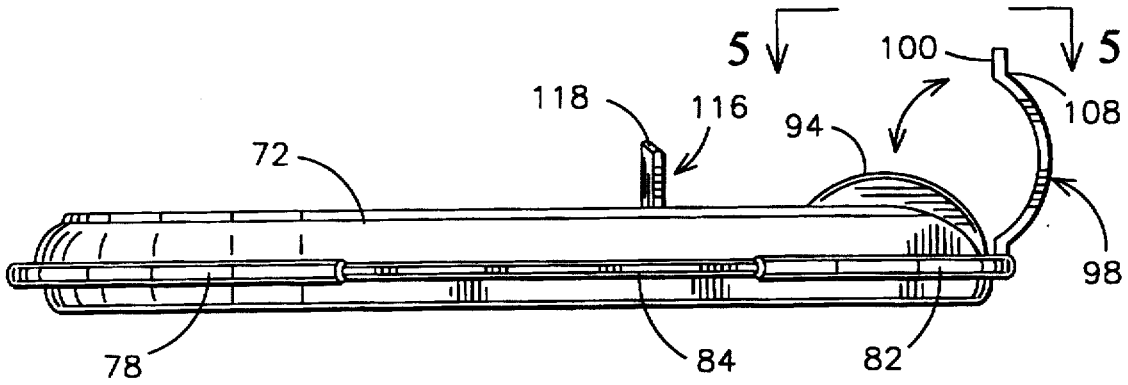
FIG. 4 is a side elevational view of the tray with the coin compartment lid open.
Figure 5:
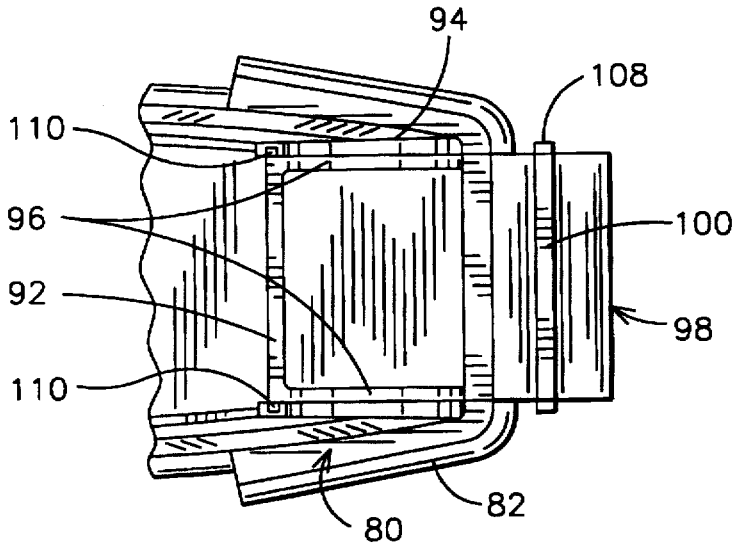
FIG. 5 is a top plan detail in the direction 5—5 in FIG. 4.
Figure 7:
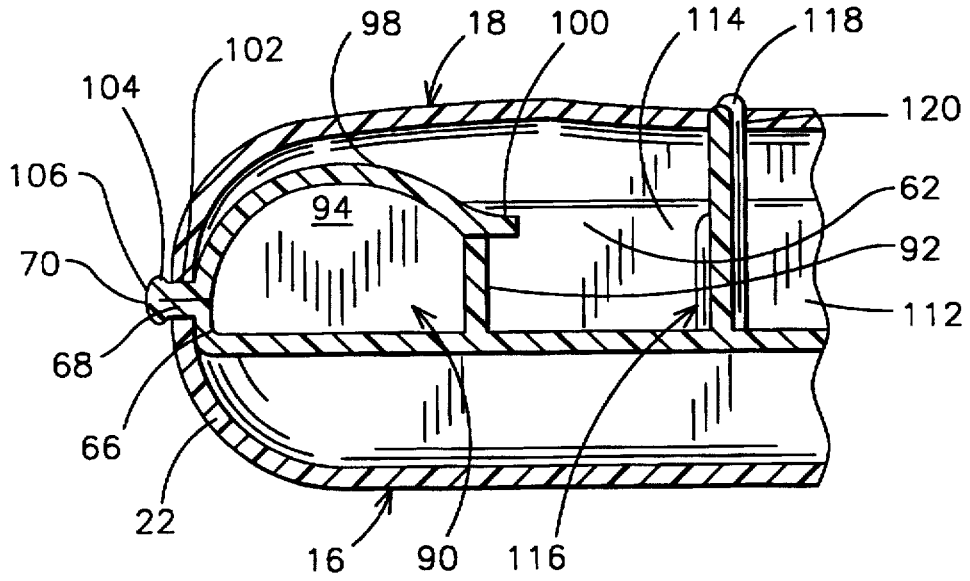
FIG. 7 is an enlarged cross-sectional detail taken substantially on a plane passing along line 7—7 in FIG. 1.

The lid 98, noting FIGS. 5 and 7 in particular, is of an upwardly domed or arcing configuration conforming to the arc of the side walls 94 and more particularly the arcing shoulders 96 defined thereon. The forward or inner edge of the lid 98 is laterally turned as at 100 to define a grasping lip for the selective opening of the lid 98. The rear or back edge of the lid 98 includes a laterally directed flange 102 which is an inverted substantial duplicate of the flange 68 and similarly includes an enlarged edge or bead 104 which, in combination with the bead 70 of the flange 68, defines a bead similar to the unitary bead 82. The combined beads 70 and 104 are integrally joined by a living hinge 106 defined therebetween to allow for an upward and rearward pivoting of the lid to open the compartment, note FIG. 4. Both beaded flanges 68 and 102, when the compartment lid 98 is closed and the tray positioned within the closed shell 12, are received and clamped between the corresponding end wall edges, thus retain the closed lid.

The lid 98 is also provided with a latch assembly comprising a pair of small laterally extending lugs 108 to the opposite sides of the forward edge thereof immediately adjacent the laterally extending lift flange 100. These lugs are snap-receiving within corresponding sockets or notches 110 defined in the opposed inner faces of the opposed side walls 94 immediately above the opposed lid-supporting shoulders 96 adjacent the front compartment wall 92. While the engagement is such as to retain the lid closed, simple finger pressure, lifting upward on the lift flange 100, will disengage the lugs 108 and allow for a free opening movement of the compartment lid.

Figure 8:
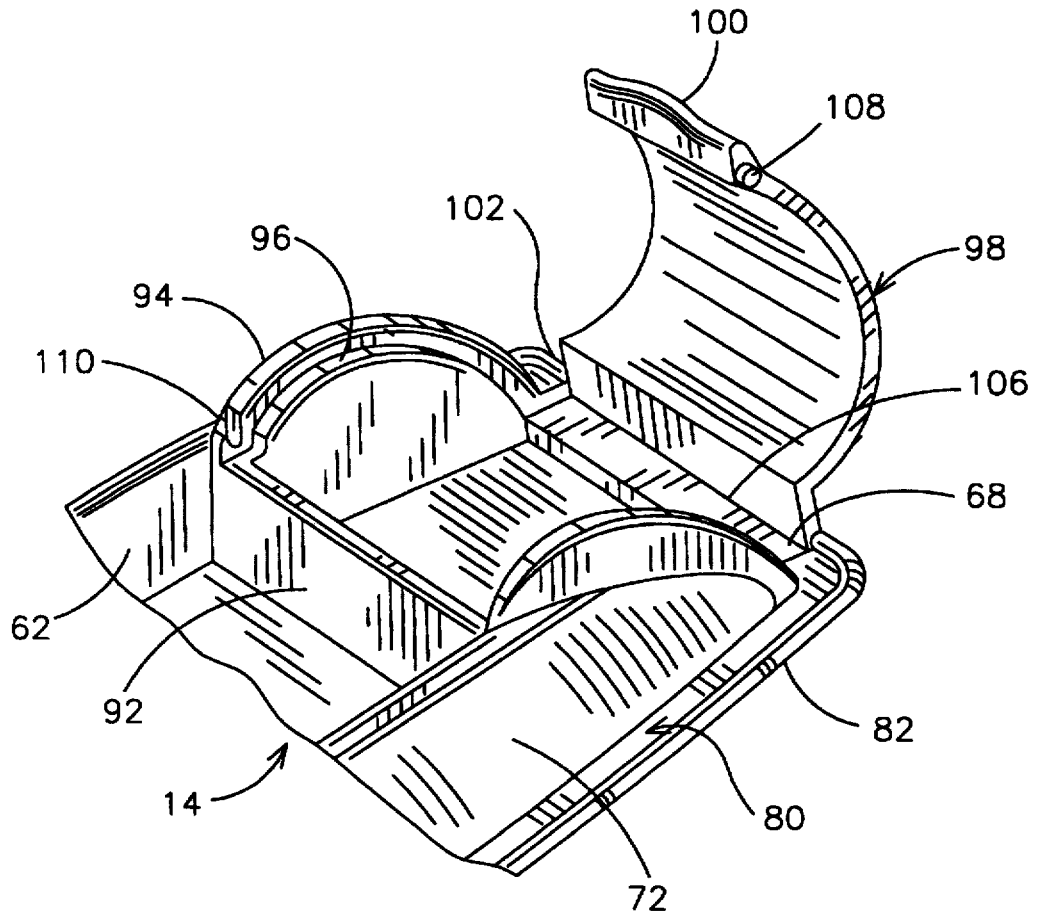
FIG. 8 is a perspective detail of the coin compartment with the lid open.

As will be appreciated from FIGS. 4 and 8 in particular, the side walls 94 of the coin compartment arc upwardly above the side walls of the tray to provide for a substantial depth to the coin compartment with the height of this compartment being only slightly less than the depth of the shell between the tray bottom wall 60 and the top panel 36 of the cover.

The tray is further divided into an elongate forward compartment 112 and a relatively shorter rear compartment 114 by a transverse partition 116 extending between the opposed tray walls 62. The partition 116 includes a concavo-convex central portion 118 which extends to a height above the end portions of the partition 116, which end portions are at or below the height of the tray walls 62, sufficient to extend through an arcuate receiving slot 120 in the top panel 36 of the cover 18. This slot 120 is defined transversely across an elongate depression 122 in the top panel with the arcing upper edge of the central projecting portion 118 of the partition 116 aligned within this depression, upon a closing of the cover thereover, so as to be of equal height with or slightly below the remaining upper surface of the top panel 36 to avoid any projection therebeyond as might interfere with the desired smooth exterior. As will be appreciated from FIG. 6, the arcing nature of the upper edge of this portion 118 actually conforms to the transverse concavity of the depression 122 whereby a continuous transverse arc is provided by this upper edge and the adjoining upper surfaces of the top panel 36.

The primary purpose of this partition projecting portion 118 is to provide a convenient means for a release of the tray 14 from the cover. In other words, it is contemplated that there will be a tendency, through frictional engagement, for the tray to pivot upwardly with the cover as the case is opened, thus exposing the lower base compartment. If the cover is to be raised without the tray raising therewith, one need merely exert a slight finger pressure on the projecting portion of the partition as the cover is raised whereby disengagement of the tray from the cover is readily achieved with substantially no effort. The partition also provides a convenient means for lifting the tray from the base. It is to be recognized that the shell, notwithstanding the edge clamping relationship between the shell and the tray, can be closed without the tray positioned therein should it be necessary to temporarily accommodate items too bulky to be received either within the tray or within the base below the tray.

The foregoing is considered illustrative of the invention, and related embodiments, as they fall within the scope of the claims hereinafter, are also to be considered within the scope of the invention.

We claim:

1. A carrying case for small items comprising a case shell including a base and a cover selectively closed over said base, and a removable tray received in said shell and partially within each of said base and said cover, said shell base having a bottom panel with peripheral walls extending upward therefrom and terminating in coplanar upper edges, said cover having a top panel with peripheral walls depending therefrom and terminating in coplanar lower edges, said lower edges, with said cover closed over said base, being coextensive with and aligned over said upper edges, said tray including a bottom panel with peripheral walls extending upward from said tray bottom panel, a peripheral flange integral with and extending laterally outward from said tray walls in spaced relation above said tray bottom panel, said tray flange seating between said upper edges of said base and said lower edges of said cover closed over said base, selected longitudinally extending portions of said peripheral flange having outer edges with beads defined therealong, said beads lying immediately outward of said base and cover walls adjacent said respective base upper edges and cover lower edges, and latch means on said base and said cover for selectively retaining said cover closed over said base.

2. The carrying case of claim 1 wherein said base walls include elongate front and rear walls, said cover walls including elongate front and rear walls, said base and cover rear walls being integrally joined by an elongate living hinge extending longitudinally therealong and therebetween, said latch means comprising a forwardly projecting keeper edge on said base front wall at said upper edge thereof, and an access recess defined in said base front wall immediately below and inward of said keeper edge, and a latch panel on said cover front wall depending below said lower edge thereof for selective engagement with said keeper edge.

3. The carrying case of claim 2 wherein said front and rear walls of both said base and said cover are outwardly convex relative to each other, said base walls including a transverse first end wall extending between the front and rear base walls, said base front and rear walls converging toward a second end of said base and defining a tapered second end wall thereat, said convex front and rear walls having a maximum width therebetween intermediate said first and second end walls, said cover walls including a first transverse end wall extending between said front and rear walls of said cover, and a second tapered end wall defined by converging portions of said cover front and rear walls.

4. The carrying case of claim 3 wherein said tray walls include opposed elongate side walls, a transverse first end wall and a tapered second end wall, and a coin compartment defined in said tray immediately forward of said tray first end wall, said coin compartment including a compartment wall transversely across said tray bottom panel inward of said tray first end wall wherein said compartment is defined between said tray first end wall and said compartment wall, a lid overlying said coin compartment and extending between said tray first end wall and said compartment wall, and integral hinge means between said lid and said tray first end wall for selective pivotal movement of said lid between a closed position over said coin compartment and an open position upwardly and outwardly swung toward said tray first end wall.

5. The carrying case of claim 4 wherein said coin compartment includes opposed facing side wall portions, opposed inwardly directed shoulders defined on said side wall portions for engagement and support of said lid thereon in the closed position of said lid.

6. The carrying case of claim 5 wherein said tray includes a partition extending transversely across said tray bottom panel between said opposed side walls of said tray, said partition being positioned intermediate said coin compartment wall and said second end wall of said tray wherein additional tray compartments are defined.

7. The carrying case of claim 6 wherein said partition includes a central portion extending above said upper edges of said tray walls, said cover top panel having a transverse opening defined therein and receiving the extending central portion of said tray partition therethrough allowing for a release of said tray from said cover upon a downward force on said projecting portion as said cover is pivoted opened.

8. The carrying case of claim 7 including an elongate depression in said top panel of said cover, said partition central portion being within said depression and at a height therein no greater than the upper surface of said cover top panel.

9. The carrying case of claim 4 wherein said coin compartment lid has a forward edge overlying said coin compartment wall with a lift flange integral with said forward edge and extending beyond said compartment wall, said opposed side wall portions of said coin compartment having upwardly directed restricted sockets defined adjacent said compartment wall, said lid having projecting lugs thereon selectively engaged within said sockets for a releasable retention of said lid in the closed position thereof.

10. The carrying case of claim 1 wherein said tray walls include opposed elongate side walls, a transverse first end wall and a tapered second end wall, and a coin compartment defined in said tray immediately forward of said first end wall, said coin compartment including a compartment wall transversely across said tray bottom panel inward of said first end wall wherein said compartment is defined between said first end wall and said compartment wall, a lid overlying said coin compartment and extending between said tray first end wall and said compartment wall, and integral hinge means between said lid and said tray first end wall for selective pivotal movement of said lid between a closed position over said coin compartment and an open position upwardly and outwardly swung toward said tray first end wall.

11. The carrying case of claim 10 wherein said coin compartment includes opposed facing side wall portions, opposed inwardly directed shoulders defined on said side wall portions for engagement and support of said lid thereon in the closed position of said lid.

12. The carrying case of claim 11 wherein said coin compartment lid and said shoulder supporting said lid are of an upward convex configuration between the tray first end wall and said coin compartment wall to define an interior compartment height greater than said tray first end wall and said compartment wall.

13. The carrying case of claim 11 wherein said tray includes a partition extending transversely across said tray bottom panel between said opposed side walls of said tray, said partition being positioned intermediate said coin compartment wall and said second end wall of said tray wherein additional tray compartments are defined.

14. A carrying case for small items comprising a case shell including a base and a cover selectively closed over said base, and a removable tray received in said shell between and partially within each of said base and said cover, said tray including a bottom panel with peripheral walls extending upward from said tray bottom panel, said tray walls including opposed elongate side walls, a transverse first end wall and a tapered second end wall, and a coin compartment defined in said tray immediately forward of said first end wall, said coin compartment including a compartment wall transversely across said tray bottom panel inward of said first end wall wherein said compartment is defined between said first end wall and said compartment wall, a lid overlying said coin compartment and extending between said tray first end wall and said compartment wall, an integral hinge means between said lid and said tray first end wall for selective pivotal movement of said lid between a closed position over said coin compartment and an open position upwardly and outwardly swung toward said tray first end wall.

15. The carrying case of claim 14 wherein said coin compartment includes opposed facing side wall portions, opposed inwardly directed shoulders defined on said side wall portions for engagement and support of said lid thereon in the closed position of said lid.

16. The carrying case of claim 15 wherein said tray includes a partition extending transversely across said tray bottom panel between said opposed side walls of said tray, said partition being positioned intermediate said coin compartment wall and said second end wall of said tray wherein additional tray compartments are defined.

17. The carrying case of claim 15 wherein said coin compartment lid and said shoulder supporting said lid are of an upward convex configuration between the tray first end wall and said coin compartment wall to define an interior compartment height greater than said tray first end wall and said compartment wall.

* * * * *